US005408980A

United States Patent [19]

Doering et al.

[11] Patent Number: 5,408,980

[45] Date of Patent: Apr. 25, 1995

[54] AIR/FUEL CONTROL METHOD WITH ADAPTIVE FEEDBACK ACTUATION

[75] Inventors: Jeffrey A. Doering, Dearborn; Allan J. Kotwicki, Sterling Heights; Michael P. Falandino, Wyandotte, all of Mich.

[73] Assignee: Ford Motor Company, Dearborn, Mich.

[21] Appl. No.: 202,145

[22] Filed: Feb. 25, 1994

[51] Int. Cl.[6] ..... F02D 41/14

[52] U.S. Cl. ..... 123/674

[58] Field of Search ..... 123/674, 698, 703; 60/276, 270, 277, 285

[56] References Cited

U.S. PATENT DOCUMENTS

| | | | |
|---|---|---|---|
| 3,973,529 | 8/1976 | Wessel et al. | 123/676 |
| 4,109,615 | 8/1978 | Asano | 123/676 |
| 4,120,269 | 10/1978 | Fujishiro | 123/676 |
| 4,132,200 | 1/1979 | Asano et al. | 123/676 |
| 4,170,965 | 10/1979 | Aono | 123/676 |
| 4,187,806 | 2/1980 | Schnurle et al. | 123/676 |
| 5,363,646 | 11/1994 | Orzel et al. | 123/674 |
| 5,363,830 | 11/1994 | Morikawa | 123/674 |

OTHER PUBLICATIONS

Regelung der Gemischzusammensetzung bei Einspritz-ottomotoren mit Hilfe der Lambda-Sonde, Bosch Techn. Berichte 6 (1978).

*Primary Examiner*—Raymond A. Nelli

*Attorney, Agent, or Firm*—Allan J. Lippa; Roger L. May

[57] ABSTRACT

An engine air/fuel control system includes an apparatus and method for adaptively setting an initialization period preceding closed loop fuel control. During the initialization period, fuel delivered to the engine is modulated by a periodic waveform. A high voltage signal associated with the high output state of an exhaust gas oxygen sensor and a low voltage signal associated with the low voltage state of the exhaust gas oxygen sensor are sampled. When the difference between these signals exceeds a preselected value, the initialization period is terminated and closed loop fuel control is actuated.

17 Claims, 7 Drawing Sheets

AIR/FUEL CONTROL METHOD WITH ADAPTIVE FEEDBACK ACTUATION

BACKGROUND OF THE INVENTION

The field of the invention relates to control systems for controlling engine air/fuel operation in response to exhaust gas sensors.

U.S. Pat. No. 4,132,200 discloses a feedback control system in which a feedback signal is generated by comparing an exhaust gas oxygen sensor output to a reference signal. The reference signal is generated by time averaging the sensor output. During open loop control, fuel is delivered in relation to a fuel signal which is biased rich and dithered. When an average in the number of sensor output transitions beyond the reference value exceeds a threshold, feedback control is initiated.

The inventors herein have recognized numerous problems with the above approaches. For example, the switch from open loop to feedback control may be delayed beyond the time at which the exhaust gas oxygen sensor is sufficiently heated to fully operable. This delay occurs because two averages are needed requiring numerous cycles of the sensor output. One average is required to generate the reference signal, and another average of the comparison between sensor output and the reference is also required. The need remains to more quickly and accurately determine when the sensor becomes fully operable and feedback control is commenced.

SUMMARY OF THE INVENTION

An object of the invention herein is to learn when the exhaust gas oxygen sensor becomes operable and initiate feedback control at that time.

The above object is achieved, and problems of prior approaches overcome, by providing an engine air/fuel control method and control system responsive to an output from an exhaust gas sensor. In one particular aspect of the invention, the method comprises the steps of: modulating fuel delivered to the engine during an initialization period; terminating the initialization period when a difference between high and low excursion in the sensor output exceeds a preselected value; and adjusting fuel delivered to the engine in response to a feedback variable derived from the sensor output, the adjusting step being initiated in response to the termination of the initialization period.

An advantage of the above aspect of the invention is that feedback air/fuel control is actuated at the time the exhaust gas sensor commences desired operation. Another advantage is that the initialization period, typically occurring after engine start or a transient engine operating condition, is minimized thereby minimizing engine emissions.

In another aspect of the invention, the control method comprises: modulating fuel delivered to the engine during an initialization period; generating a first signal by storing the sensor output as the first signal while the sensor output is greater than a previously stored first signal and decreasing the previously stored first signal at a predetermined rate while the sensor output is less than the previously stored first signal; generating a second signal by storing the sensor output as the second signal while the sensor output is less than a previously stored second signal and increasing the previously stored second signal at a predetermined rate while the sensor output is greater than the previously stored second signal; terminating the initialization period when a difference between the first signal and the second signal exceeds a preselected value; and adjusting fuel delivered to the engine in response to a feedback variable derived from the sensor output, the adjusting step being initiated in response to the termination of the initialization period.

An advantage of the above aspect of the invention is that the duration of the initialization period is adaptively learned so that feedback control commences at the approximate time the exhaust gas sensor is sufficiently warmed to commence feedback control.

BRIEF DESCRIPTION OF THE DRAWINGS

The above object and advantages of the invention claimed herein and others will be more clearly understood by reading an example of an embodiment in which the invention is used to advantage with reference to the attached drawings wherein:

DESCRIPTION OF AN EMBODIMENT

Figure 1:
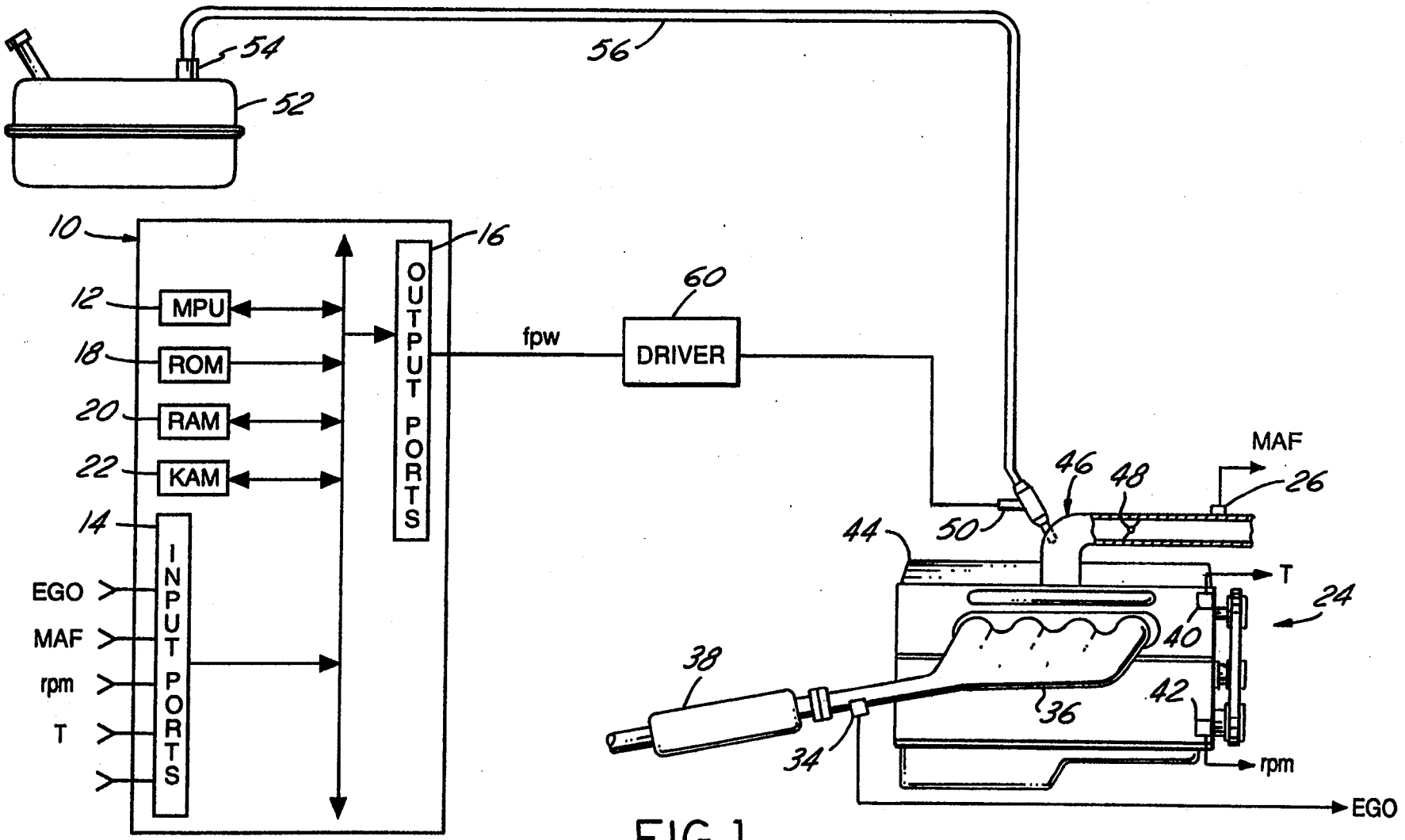
FIG. 1 is a block diagram of an embodiment in which the invention is used to advantage.

Controller 10 is shown in the block diagram of FIG. 1 as a conventional microcomputer including: microprocessor unit 12; input ports 14 including both digital and analog inputs; output ports 16 including both digital and analog outputs; read only memory (ROM) 18 for storing control programs; random access memory (RAM) 20 for temporary data storage which may also be used for counters or timers; keep-alive memory (KAM) 22 for storing earned values; and a conventional data bus.

In this particular example, exhaust gas oxygen (EGO) sensor 34 is shown coupled to exhaust manifold 36 of engine 34 upstream of conventional catalytic converter 38. Tachometer 42 and temperature sensor 40 are each shown coupled to engine 24 for providing, respectively, signal rpm related to engine speed and signal T related to engine coolant temperature to controller 10.

Intake manifold 44 of engine 24 is shown coupled to throttle body 46 having primary throttle plate 48 positioned therein. Throttle body 46 is also shown having fuel injector 50 coupled thereto for delivering liquid fuel in proportion to pulse width signal fpw from controller 10. Fuel is delivered to fuel injector 50 by a conventional fuel system including fuel tank 52, fuel pump 54, and fuel rail 56.

Figure 2:
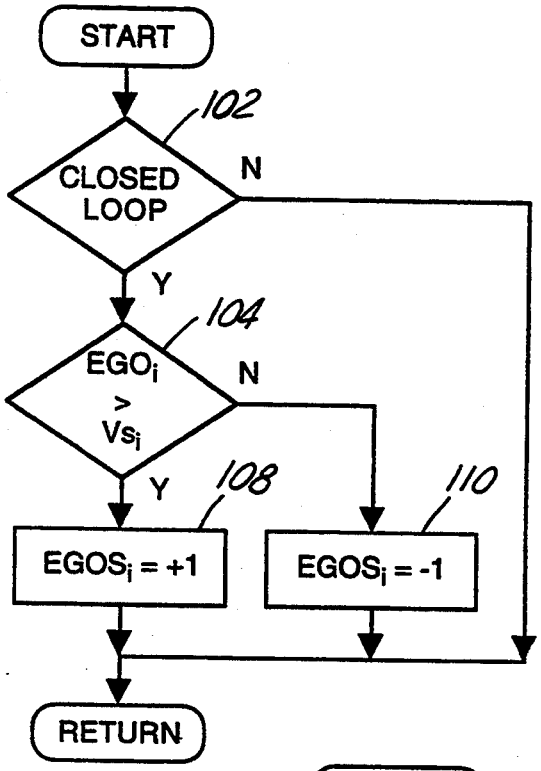
FIGS. 2–5 are high level flowcharts illustrating various steps performed by a portion of the embodiment illustrated in FIG. 1.

Referring now to FIG. 2, two-state signal EGOS is generated by comparing signal EGO from sensor 34 to adaptively learned reference value Vs. More specifically, when various operating conditions of engine 24, such as temperature (T), exceed preselected values, closed-loop air/fuel feedback control is commenced (step 102). Each sample period of controller 10, the output of sensor 34 is sampled to generate signal $EGO_i$. Each sample period (i) when signal $EGO_i$ is greater than adaptively learned reference or set voltage $Vs_i$ (step 104), signal $EGOS_i$ is set equal to a positive value such as unity (step 108). On the other hand, when signal $EGO_i$ is less than reference value $Vs_i$ (step 104) during sample time (i), signal $EGOS_i$ is set equal to a negative value such as minus one (step 110). Accordingly, two-state signal EGOS is generated with a positive value indicating exhaust gases are rich of a desired air/fuel ratio such as stoichiometry, and a negative value when exhaust gases are lean of the desired air/fuel ratio. In response to signal EGOS, feedback variable FFV is generated as described later herein with particular reference to FIG. 4 for adjusting the engine's air/fuel ratio.

Figures 3, 4:
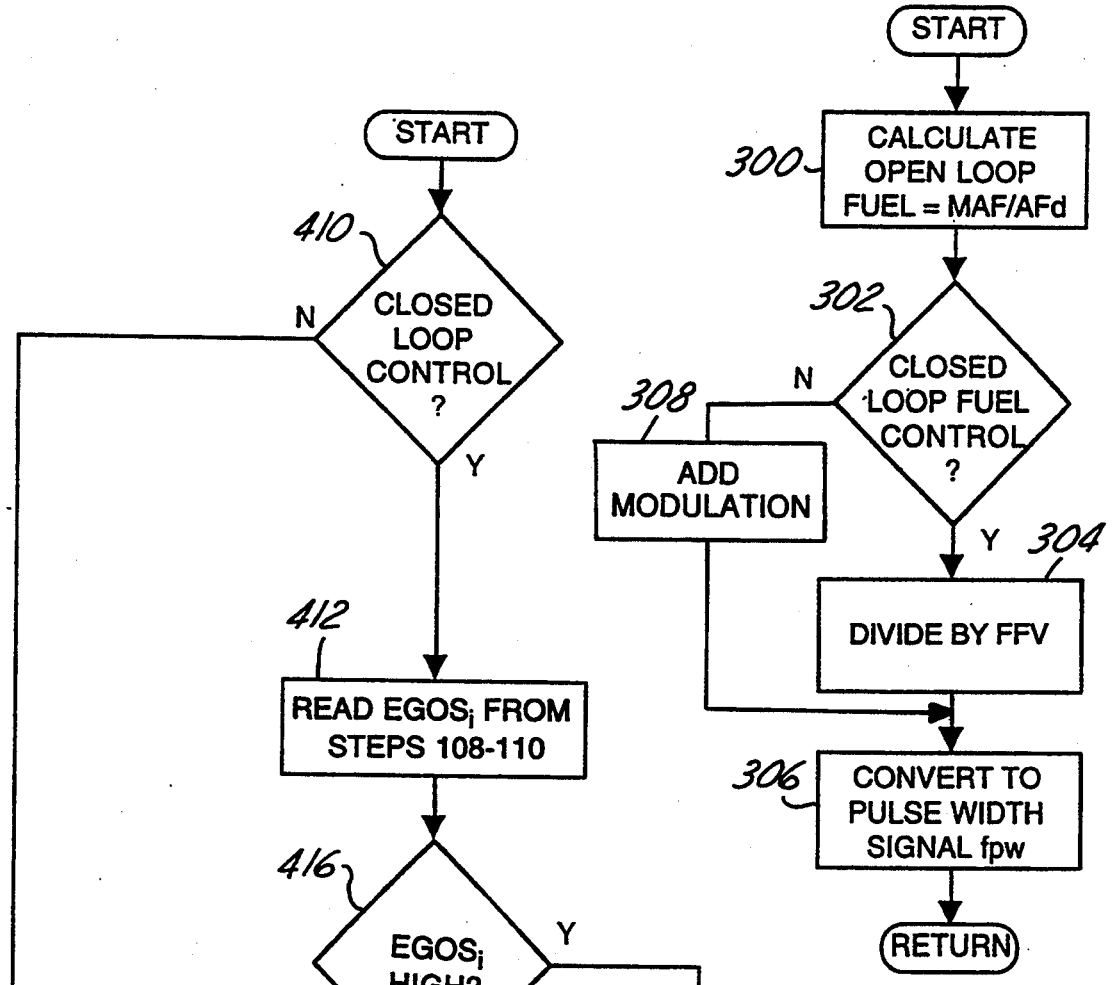

A flowchart of the liquid fuel delivery routine executed by controller 10 for controlling engine 24 is now described beginning with reference to the flowchart shown in FIG. 3. An open loop calculation of desired liquid fuel is first calculated in step 300. More specifically, the measurement of inducted mass airflow (MAF) from sensor 26 is divided by a desired air/fuel ratio (AFd). After a determination is made that closed loop or feedback control is desired (step 302), the open loop fuel calculation is trimmed by fuel feedback variable FFV to generate desired fuel signal fd during step 304. This desired fuel signal is converted into fuel pulse width signal fpw for actuating fuel injector 50 (step 306) via injector driver 60 (FIG. 1).

As described in greater detail later herein with particular reference to FIG. 9, desired fuel signal fd is modulated (step 308) by a periodic signal during an initialization period. Any periodic signal may be used such as a triangular wave, sine wave, or square wave. This initialization period precedes and is preparatory to closed loop feedback control.

The air/fuel feedback routine executed by controller 10 to generate fuel feedback variable FFV is now described with reference to the flowchart shown in FIG. 4. After closed control is commenced (step 410), signal $EGOS_i$ is read during sample time (i) from the routine previously described with respect to steps 108–110. When signal $EGOS_i$ is low (step 416), but was high during the previous sample time or background loop (i-1) of controller 10 (step 418), preselected proportional term Pj is subtracted from feedback variable FFV (step 420). When signal $EGOS_i$ is low (step 416), and was also low during the previous sample time (step 418), preselected integral term Δj is subtracted from feedback variable FFV (step 422).

Similarly, when signal EGOS is high (step 416), and was also high during the previous sample time (step 424), integral term Ai is added to feedback variable FFV (step 426). When signal EGOS is high (step 416), but was low during the previous sample time (step 424), proportional term Pi is added to feedback variable FFV (step 428).

Adaptively learning set or reference Vs is now described with reference to the subroutine shown in FIG. 5. For illustrative purposes, reference is also made to the hypothetical operation shown by the waveforms presented in FIGS. 6A and 6B. In general, adaptively learned reference Vs is determined from the midpoint between high voltage signal Vh and low voltage signal V1. Signals Vh and V1 are related to the high and low values of signal EGO during each of its cycles with the addition of several features which enables accurate adaptive learning under conditions when signal EGO may become temporarily pegged at a rich value, or a lean value, or shifted from its previous value.

Figure 5:
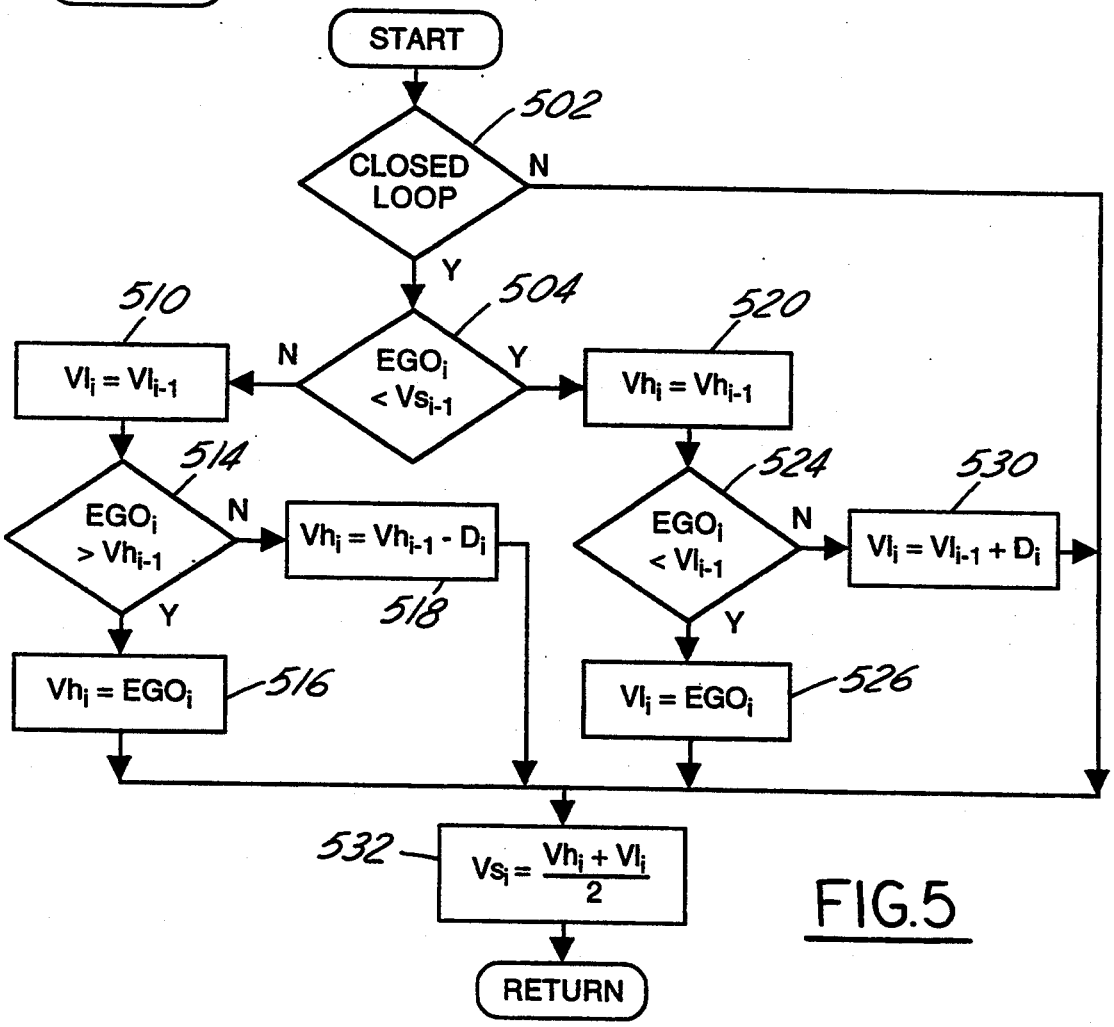

Referring first to FIG. 5, after closed loop air/fuel control is commenced (step 502), signal $EGO_i$ for this sample period (i) is compared to reference $Vs_{i-1}$ which was stored from the previous sample period (i-1) in step 504. When signal $EGO_i$ is greater than previously sampled signal $Vs_{i-1}$, the previously sampled low voltage signal. $Vl_{i-1}$ is stored as low voltage signal $Vl_i$ for this sample period (i) in step 510. This operation is shown by the graphical representation of signal V1 before time t2 shown in FIG. 6A. Returning to FIG. 5, when signal $EGO_i$ is greater than previously sampled high voltage signal $Vh_{i-1}$ (step 514), signal $EGO_i$ is stored as high voltage signal $Vh_i$ for this sample period (i) in step 516. This operation is shown in the hypothetical example of FIG. 6A between times t1 and t2.

Figure 6A:
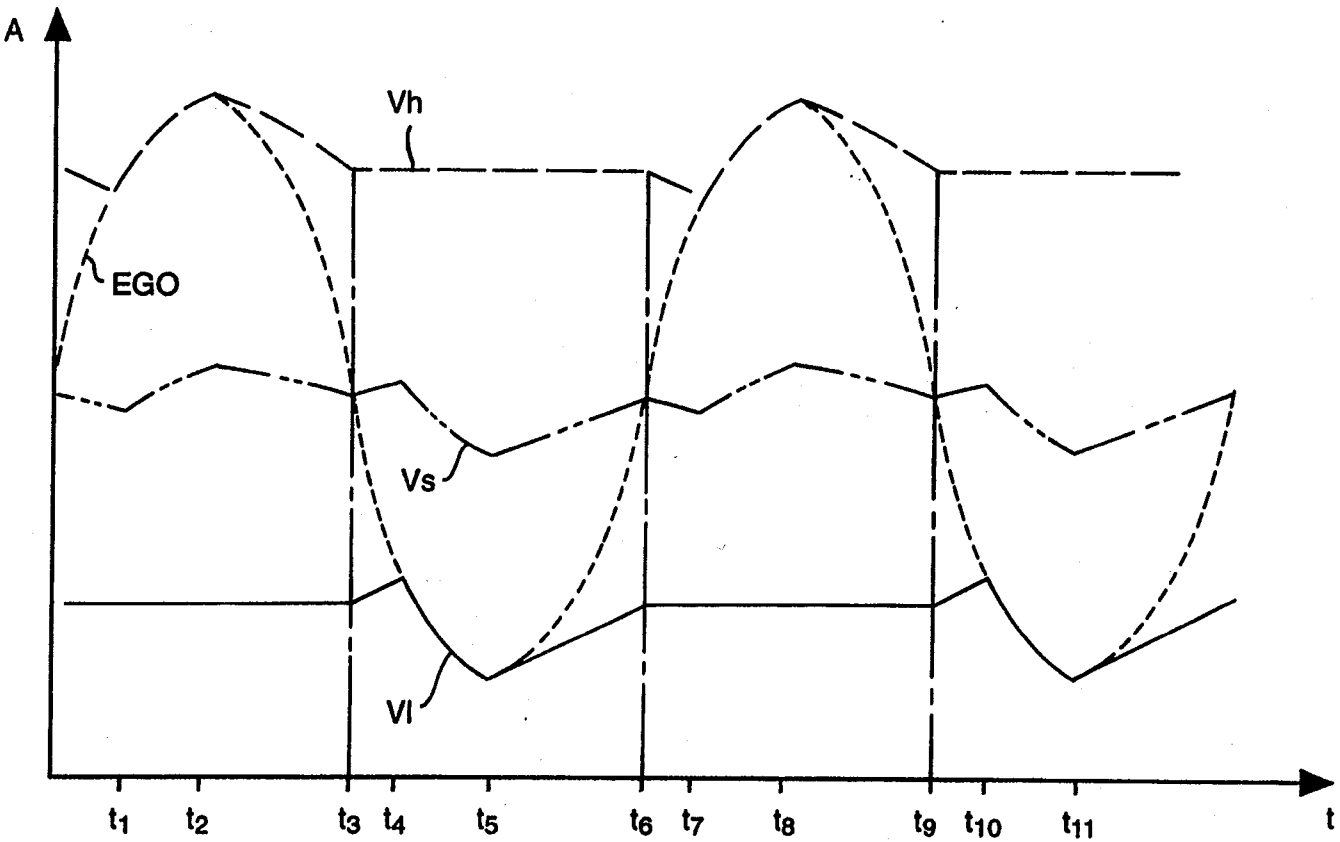
FIGS. 6A, 6B, 7, and 8 illustrate various outputs associated with a portion of the embodiment illustrated in FIG. 1 and explained with reference to the flowcharts shown in FIGS. 2–5.

When signal $EGO_i$ is less than previously stored high voltage signal $Vh_{i-1}$ (step 514), but greater than signal $VS_{1-1}$, high voltage signal $Vh_i$ is set equal to previously sampled high voltage $Vh_{i-1}$ less predetermined amount $D_i$ which is a value corresponding to desired signal decay (step 518). This operation is shown in the hypothetical example presented in FIG. 6A between times t2 and t3. As shown in FIG. 6A, high voltage signal Vh decays until signal $EGO_i$ falls to a value less than reference Vs at which time high voltage signal Vh is held constant. Although linear decay is shown in this example, nonlinear decay and experiential decay may be used to advantage. Referring to the corresponding operation shown in FIG. 5, high voltage signal $Vh_i$ is stored as previously sampled high voltage signal $Vh_{i-1}$ (step 520) when signal $EGO_i$ is less than previously sampled reference $Vs_{i-1}$ (step 504).

Continuing with FIG. 5, when signal $EGO_i$ is less than both previously sampled reference $Vs_{i-1}$ and previously sampled low voltage signal $V1_{i-1}$ (step 524) signal $EGO_i$ is stored as low voltage signal $V1_i$ (step 526). An example of this operation is presented in FIG. 6A between times t4 and t5.

When signal $EGO_i$ is less than previously sampled reference $Vs_{i-1}$ (step 504), but greater than previously sampled high voltage signal $Vl_{i-1}$ (step 524), high voltage signal $Vl_i$ is set equal to previously sampled high voltage signal $Vl_i$-1 plus predetermined decay value $D_i$ (step 530). The decay applied in step 530 may be different from that applied in step 518. An example of this operation is shown graphically in FIG. 6A between times t5 and t6.

As shown in step 532 of FIG. 5, reference $Vs_i$ is calculated each sample period (i) by interpolating between high voltage signal $Vh_i$ and low voltage signal $V1_i$ each sample time (i) represented by $Vs=(\delta\ Vh1+(1\text{-}d)\ Vli)/2$. In this particular example, a midpoint calculation is used to advantage.

Figure 6B:
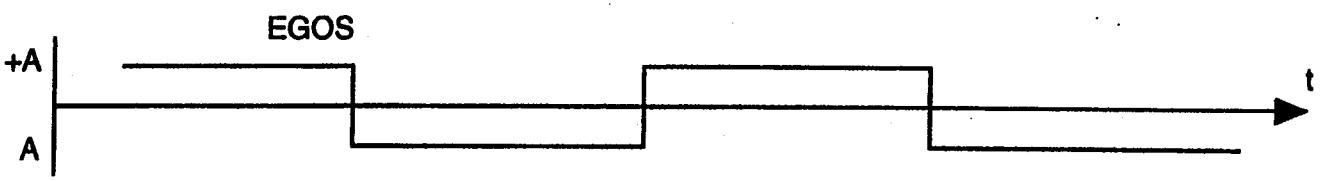

Referring to the hypothetical example presented in FIGS. 6A and 6B, signal EGOS is set at a high output amplitude (+A) when signal EGO is greater than reference Vs and set at a low value (−A) when signal EGO is less than reference Vs.

In accordance with the above described operation, reference Vs is adaptively learned each sample period so that signal EGOS is accurately determined regardless of any shifts in the output of signal EGO. In addition, advantageous features such as allowing high voltage signal Vh and low voltage signal V1 to decay only to values determined by the zero crossing point of signal EGO, prevent the reference from becoming temporarily pegged when air/fuel operation runs rich or lean for prolonged periods of time. Such operation may occur during either wide-open throttle conditions or deceleration conditions.

Figure 7:
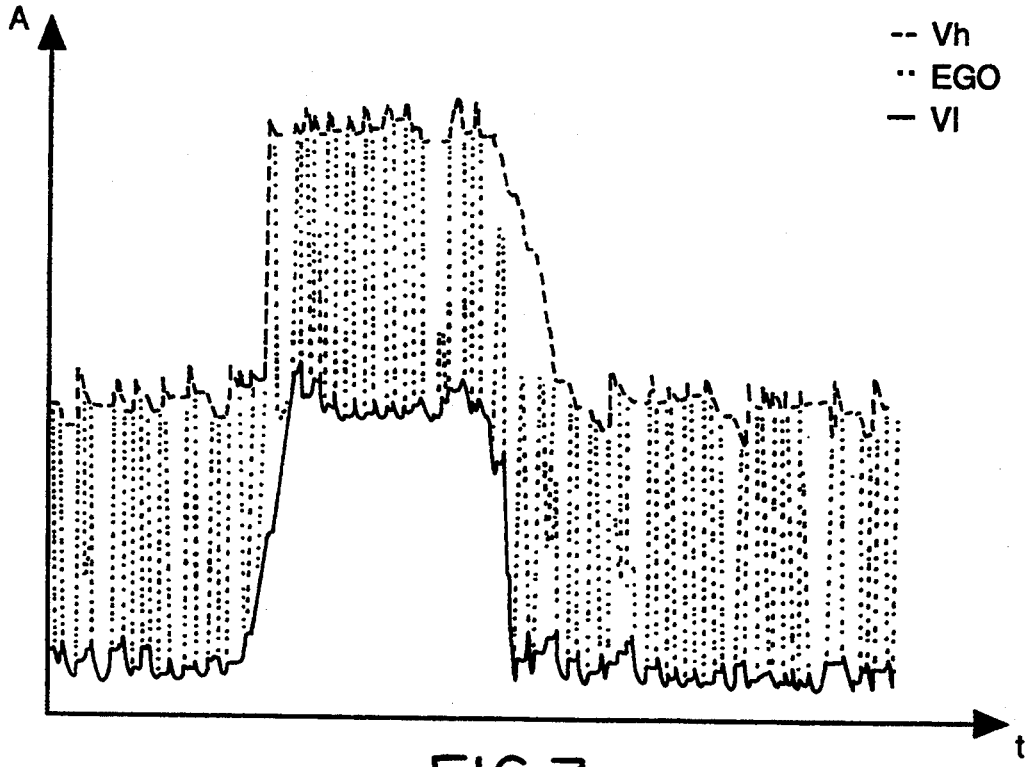
Figure 8:
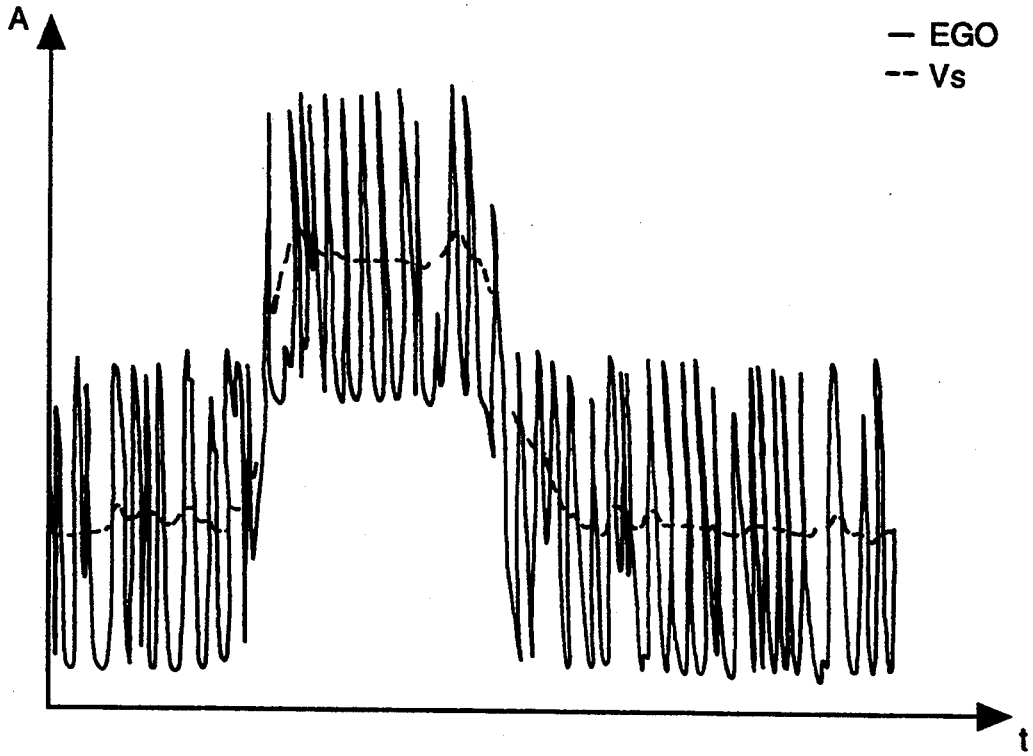

Advantages of the above described method for adaptively learning reference Vs are shown in FIGS. 7 and 8 during conditions where signal EGO incurs a sudden shift. More specifically, FIG. 7 shows a hypothetical operation wherein high voltage signal Vh and low voltage signal V1 accurately track the outer envelope of signal EGO and the resulting reference is shown accurately and continuously tracking the midpoint in peak-to-peak excursions of signal EGO in FIG. 8.

An initialization period having an adaptively learned period or time duration which precedes closed loop fuel control is now described with reference to the flowchart shown in FIG. 9 and related waveforms shown in FIGS. 10 and 11. In general, during the initialization period, open loop fuel control is modulated by superimposing a periodic signal on the desired fuel charge signal. When a form of the modulation is detected in the output of EGO sensor 34, an indication is provided that EGO sensor 34 has achieved proper operation and, accordingly, closed loop fuel control commences. Those skilled in the art will recognize that although sensor 34 is shown in this example as a conventional two-state exhaust gas oxygen sensor, the invention described herein is applicable to other types of exhaust gas oxygen sensors such as proportional sensors and is also applicable to other types of exhaust sensors such as HC and $NO_x$ sensors.

Figure 9:
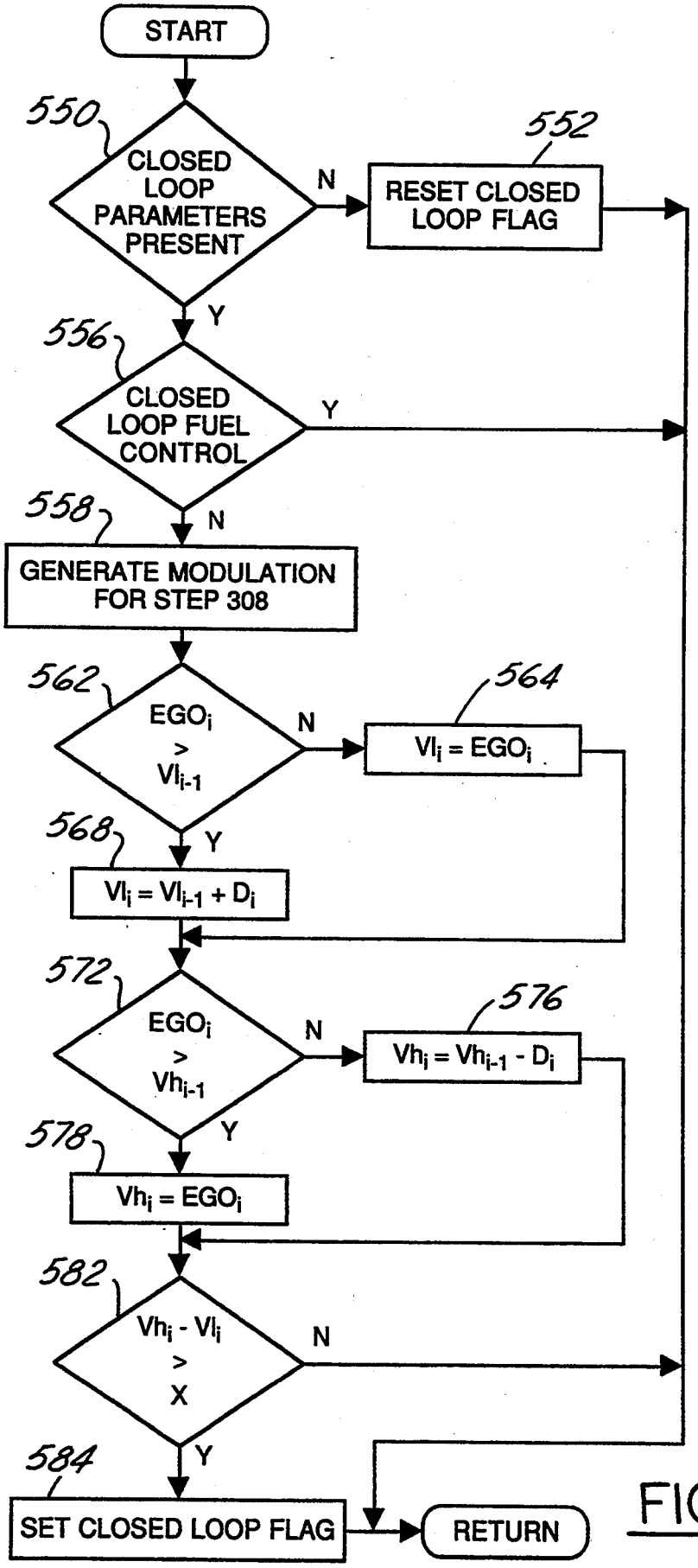
FIG. 9 is a high level flowchart illustrating various steps performed by a portion of the embodiment illustrated in FIG. 1.

First referring to FIG. 9, engine operating parameters associated with closed loop fuel control are first sampled during step 550. In this example, these parameters include engine temperature T being beyond a preselected temperature. When the closed loop parameters are absent, the closed loop flag is reset in step 552 thereby disabling closed loop fuel control. On the other hand, when the closed loop parameters are present, the initializing subroutine is entered provided that engine 24 is not presently operating in closed loop fuel control (step 556).

Upon entering the initialization period, a modulation signal having a periodic cycle such as a triangular or sinusoidal wave is first generated during step 558. As previously described herein with particular reference to FIG. 3, the modulating signal modulates the desired fuel quantity delivered to engine 24.

Continuing with FIG. 9, when signal $EGO_i$ for this sample period (i) is less than low voltage signal $Vl_{i-1}$ stored from the previous sample period (i -1), low voltage signal $V1_i$ is set equal to signal $EGO_i$ (step 564). On the other hand, when signal $EGO_i$ is greater than previously stored signal $V1_{i-1}$ (step 562), signal $V1_i$ for this sample period is set equal to previously stored signal $Vl_{i-1}$ plus predetermined value $D_i$ (step 568). In this particular example, predetermined value $D_i$ is added when required each sample time to generate a predetermined rate which is applied to increase or decrease the signals described herein.

When signal $EGO_i$ is less than previously stored high voltage signal $Vh_{i-1}$ as shown in step 572, then signal $Vh_i$ decays at a predetermined rate as provided by predetermined value $D_i$. More specifically, as shown in step 576, signal $Vh_i$ is set equal to previously stored signal $Vh_{i-1}$ less predetermined value $D_i$. However, when signal $EGO_i$ is greater than signal $Vh_{i-1}$. (step 572), signal $Vh_i$ is set equal to signal $EGO_i$ for this sample period (i) as shown in step 578.

The difference between signal $Vh_i$ and signal $V1_i$ is then compared to preselected value x during step 582. When this difference exceeds preselected value x, it is apparent that a sufficient portion of the input modulation is observed at the output of EGO sensor 34 such that closed loop fuel control should commence. Accordingly, the closed loop fuel flag is set in step 584.

Figure 10:
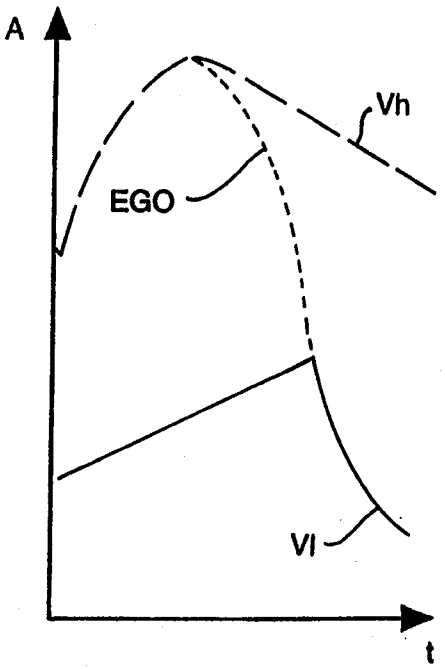
FIGS. 10–11 illustrate various outputs associated with a portion of the embodiment illustrated in FIG. 1 and explained herein with particular reference to FIG. 9.

For illustrative purposes, a hypothetical example is illustrated by the waveforms in FIG. 10. More specifically, a hypothetical signal EGO is shown and the associated high voltage signal Vh and low voltage signal V1 are illustrated by the waveforms shown in FIG. 10. For the particular example, there is a sufficient difference between signal Vh and signal Vl to terminate the initialization period and actuate closed loop feedback control.

Figure 11:
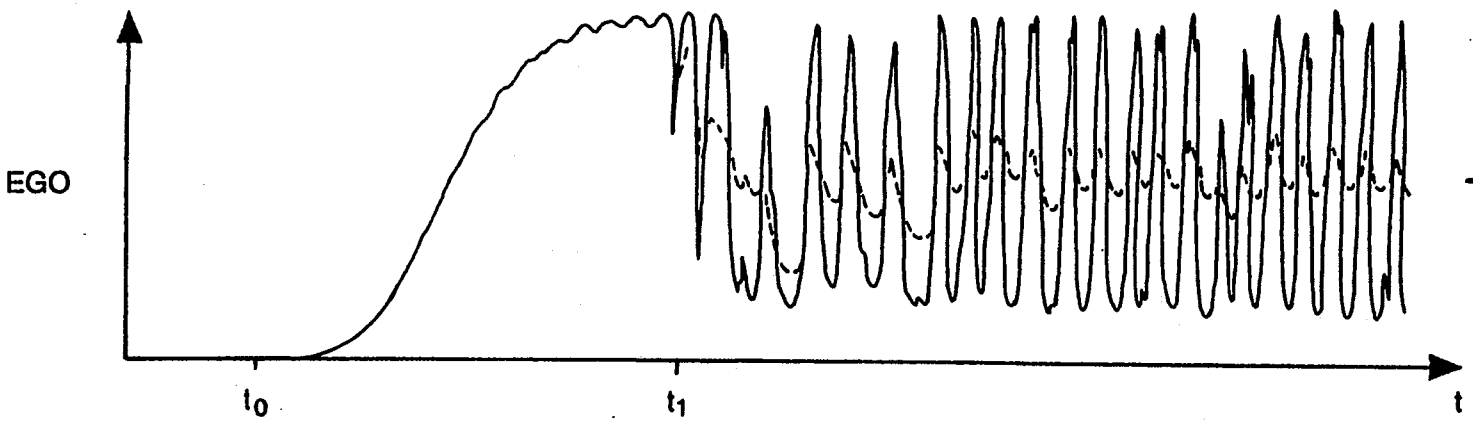

Another hypothetical operation is illustrated in FIG. 11. In this particular example, the initialization period occurs between times $t_O$ and $t_1$. At time t1, the above described input modulation is detected in signal EGO, the initialization period then terminated, and feedback control commenced.

Although one example of an embodiment which practices the invention has been described herein, there are numerous other examples which could also be described. For example, the invention may be used to advantage with proportional exhaust gas oxygen sensors. Further, other combinations of analog devices and discrete ICs may be used to advantage to generate the current flow in the sensor electrode. The invention is therefore to be defined only in accordance with the following claims.

What is claimed:

1. An engine air/fuel control method responsive to an output from an exhaust gas sensor, comprising the steps of:

modulating fuel delivered to the engine during an initialization period;

terminating said initialization period when a difference between high and low excursion in the sensor output exceeds a preselected value; and adjusting fuel delivered to the engine in response to a feedback variable derived from the sensor output, said adjusting step being initiated in response to said termination of said initialization period.

2. The control method recited in claim 1 wherein said modulating step includes the step of modulating a fuel delivery signal.

3. The control method recited in claim 2 further comprising the step of generating said fuel delivery signal by dividing a measurement of airflow inducted into the engine by a desired air/fuel ratio.

4. The method recited in claim 3 wherein said modulating step includes the step of superimposing a periodic signal on said fuel delivery signal.

5. The method recited in claim 4 wherein said periodic signal comprises a triangular wave.

6. The method recited in claim 4 wherein said periodic signal comprises a sine wave.

7. The control method recited in claim 3 wherein said step of adjusting fuel delivered to the engine further comprises the steps of integrating the sensor output to generate said feedback variable and further dividing said inducted airflow measurement by said feedback variable.

8. The method recited in claim 1 further comprising the step of generating said initialization period in response to an indication of at least one engine operating parameter exceeding a preselected value.

9. The method recited in claim 1 wherein said modulating step and said fuel adjusting step are terminated in response to an indication of at least one engine operating parameter falling below a preselected value.

10. The method recited in claim 1 wherein said sensor comprises an exhaust gas oxygen sensor.

11. An engine air/fuel control method responsive to an output from an exhaust gas sensor, comprising the steps of:

modulating fuel delivered to the engine during an initialization period;

generating a first signal by storing the sensor output as said first signal while the sensor output is greater than a previously stored first signal and decreasing said previously stored first signal at a predetermined rate while the sensor output is less than said previously stored first signal;

generating a second signal by storing the sensor output as said second signal while the sensor output is less than a previously stored second signal and increasing said previously stored second signal at a predetermined rate while the sensor output is greater than said previously stored second signal;

terminating said initialization period when a difference between said first signal and said second signal exceeds a preselected value; and adjusting fuel delivered to the engine in response to a feedback variable derived from the sensor output, said adjusting step being initiated in response to said termination of said initialization period.

12. The method recited in claim 11 wherein said fuel adjusting step generates said feedback variable by integrating a two-state signal derived from the sensor output.

13. The method recited in claim 12 further comprising the step of generating said two-state signal by comparing the sensor output to a reference value.

14. The method recited in claim 13 further comprising the step of generating said reference value by generating a midpoint between said first signal and said second signal.

15. An air/fuel control system for an internal combustion engine, comprising:

a controller maintaining an air/fuel mixture inducted into the engine near a desired air/fuel ratio in response to a feedback variable after an initialization period;

feedback means for generating said feedback variable by integrating a two-state signal generated by comparing an output from an exhaust gas oxygen sensor to an adaptively learned reference signal;

adaptive learning means for providing said reference signal by determining a midpoint between a first signal and a second signal during each of a repetitively occurring number of sample times;

first signal generating means for generating said first signal each of said sample times by storing said sensor signal as said first signal when said sensor signal is greater than said first signal from the previous sample time and decreasing said first signal by a predetermined amount when said sensor signal is greater than said previously sampled reference signal but less than said previously sampled first signal;

second signal generating means for generating said second signal each of said sample times by storing said sensor signal as said second signal when said sensor signal is less than said second signal from the previous sample time and increasing said second signal by a predetermined amount when said sensor signal is less than said previously sampled reference signal but greater than said previously sampled second signal;

modulation means for modulating fuel delivered to the engine during said initialization period; and initialization means for generating said initialization period in response to an indication of at least one engine operating parameter exceeding a preselected value and terminating said initialization period when a difference between said first signal and said second signal exceeds a preselected value.

16. The control system recited in claim 15 wherein said first signal generating means further comprises means for holding said first signal when said sensor signal is less than said reference signal from the previous sample time.

17. The control system recited in claim 16 further comprising means for holding said second signal when said sensor signal is greater than said reference signal from the previous sample time.

* * * * *